US007275956B1

(12) United States Patent
Montesano

(10) Patent No.: US 7,275,956 B1
(45) Date of Patent: Oct. 2, 2007

(54) USB CORD ORGANIZER

(76) Inventor: Joel J. Montesano, 616 S. Avery Dr., Moore, OK (US) 73160

( * ) Notice: Subject to any disclaimer, the term of this patent is extended or adjusted under 35 U.S.C. 154(b) by 0 days.

(21) Appl. No.: 11/422,942

(22) Filed: Jun. 8, 2006

(51) Int. Cl.
*H01R 13/72* (2006.01)

(52) U.S. Cl. ..... 439/501; 439/13

(58) Field of Classification Search ..... 439/501, 439/502, 4, 13, 27; 320/111, 107
See application file for complete search history.

(56) References Cited

U.S. PATENT DOCUMENTS 4,353,613 A * 10/1982 Carlow ..... 439/501
5,669,571 A 9/1997 Graybill
6,147,859 A 11/2000 Abboud
6,165,010 A 12/2000 Prazoff
6,361,360 B1 * 3/2002 Hwang et al. ..... 439/501
6,733,328 B2 * 5/2004 Lin et al. ..... 439/501
6,904,374 B2 6/2005 Nachamkin
6,969,275 B1 * 11/2005 Brock ..... 439/502
6,983,341 B1 1/2006 Lim et al.
7,189,106 B2 * 3/2007 Young ..... 439/501

* cited by examiner

*Primary Examiner*—Hien Vu
(74) *Attorney, Agent, or Firm*—Sturm & Fix LLP

(57) ABSTRACT

The present invention provides a USB cord organizer, including a stationary base with a USB port and an electronically coupled USB cord extending from the base. A caddy for holding and storing multiple spare USB cords is rotatably mounted on the top of the base. The caddy includes a number of cleats attached to a rotatable central port. Each of the cleats has a pair of projecting horns that engage and secure a spare USB cord when it is wrapped around the cleat. The ends of each spare USB cord are secured by a pair of clips disposed adjacent a respective pair of projecting horns. The organizer provides a USB extension cord built into a USB cord storage caddy.

3 Claims, 1 Drawing Sheet

USB CORD ORGANIZER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates to the field of cord organizers, and more particularly to a combination USB extension cord and USB storage caddy.

2. Description of the Related Art

As can be seen by reference to the following U.S. Pat. Nos. 5,669,571; 6,147,859; 6,165,010; 6,904,374; and 6,983,341, the prior art is replete with myriad and diverse organizers.

While all of the aforementioned prior art constructions are more than adequate for the basic purpose and function for which they have been specifically designed, they are uniformly deficient with respect to their failure to provide a simple, efficient and practical USB cord organizer.

As a consequence of the foregoing situation, there has existed a longstanding need for a new and improved USB cord organizer and the provision of such a construction is a stated objective of the present invention.

BRIEF SUMMARY OF THE INVENTION

Briefly stated, the present invention provides a USB cord organizer, including a stationary base with a USB port and an electronically coupled USB cord extending from the base. A caddy for holding and storing multiple spare USB cords is rotatably mounted on the top of the base. The caddy includes a number of cleats attached to a rotatable central port. Each of the cleats has a pair of projecting horns that engage and secure a spare USB cord when it is wrapped around the cleat. The ends of each spare USB cord are secured by a pair of clips disposed adjacent a respective pair of projecting horns. The organizer provides a USB extension cord built into a USB cord storage caddy.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
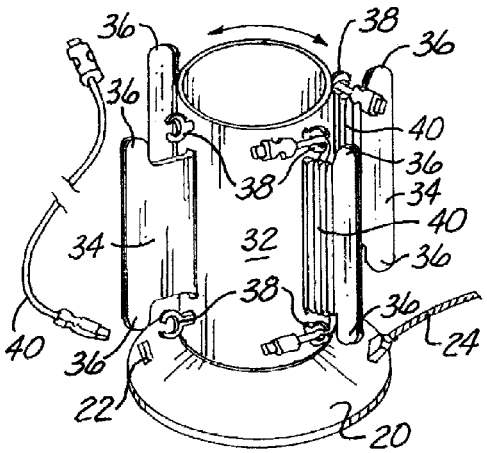
FIG. 1 is a perspective view of the USB cord organizer of the present invention showing one spare USB cord in the process of being connected to the USB port in the stationary base, and two additional spare USB cords stored on the caddy.
Figure 2:
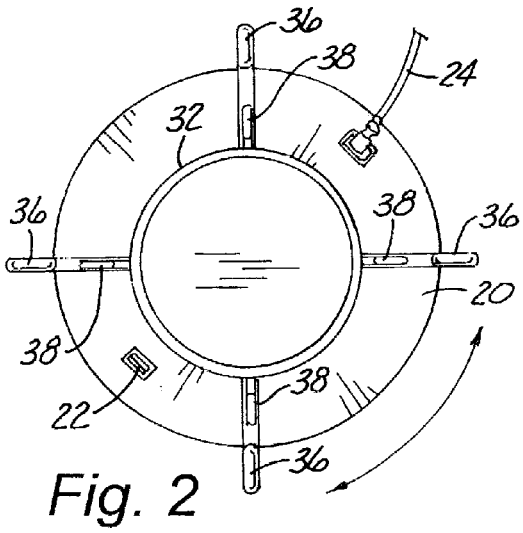
FIG. 2 is a top plan view of the USB cord organizer.
Figure 3:
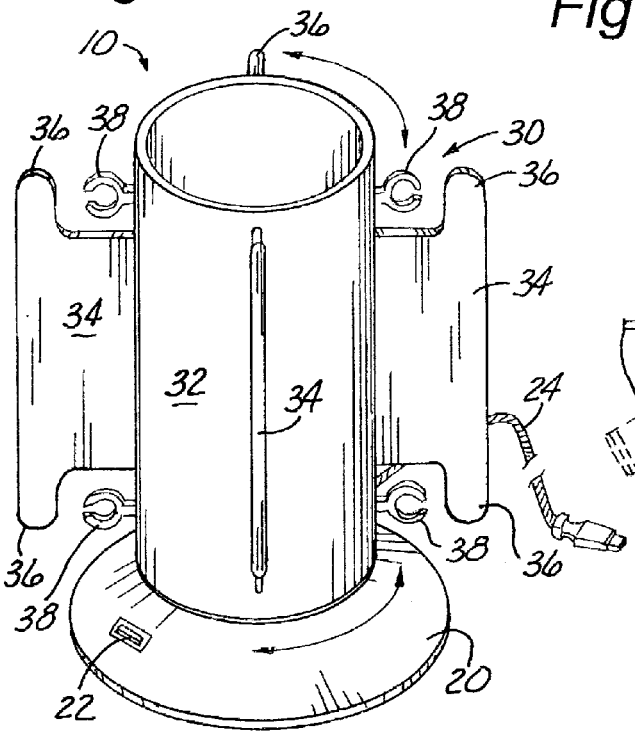
FIG. 3 is a perspective view of the USB cord organizer with no spare USB cords stored on the caddy.
Figure 4:
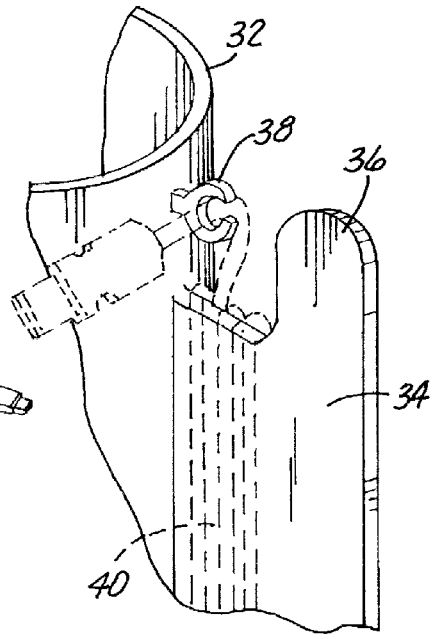
FIG. 4 is a partial perspective view showing one end of a spare USB cord secured to a clip mounted on the central port.

As can be seen by reference to the drawings, and in particularly to FIG. 1, the USB cord organizer that forms the basis of the present invention is designated generally by the reference number 10.

The USB cord organizer 10 includes a stationary base 20 with a USB port 22 and a dedicated USB 2.0 cord 24 in electronic communication with the port 22. The cord 24 can be plugged into a USB port on a computer. The stationary base 20 has a USB cord caddy 30 rotatably mounted thereon. The caddy 30 includes a rotatable central port 32 and four cleats 34 that are attached to and extend out from the central port 32. Each of the cleats 34 has a top and bottom projecting horn 36, and the central port 32 carries top and bottom cord clips 38 associated with each of the projecting horns 36. Spare USB cords 40 are stored on the caddy 30 by wrapping the spare cord 40 around the cleat 34 where it is secured by the projecting horns 36. The ends of the spare cords 40 are then secured in the top and bottom cord clips 38.

The USB cord organizer 10 allows a person to store multiple spare USB cords 40 neatly, as well as use them as needed by plugging the USB plug end of the spare cord 40 into USB port 22 in the stationary base 20. With the dedicated USB cord 24 plugged into a computer, the organizer 10 acts as an extension cord. The other end of the spare cord 40 may be plugged into a peripheral electronic device. The organizer 10 is a device that makes the use of USB cords more convenient.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A desktop USB cord organizer, comprising:

a stationary base;

a USB port disposed in the base;

a dedicated USB cord disposed to extend from the base and being in electronic communication with the USB port;

a USB cord caddy rotatably mounted on the base, the caddy including a rotatable central port, and a plurality of USB cord holders attached to and extending out from the central port, wherein a spare USB cord is secured to each of the plurality of USB cord holders;

wherein each of the plurality of USB cord holders includes cleats attached to the central port and disposed to extend out therefrom, each cleat having a pair of projecting horns disposed to engage and retain the spare USB cord when wound around the cleat.

2. The organizer of claim 1, wherein a pair of USB cord clips are disposed adjacent a respective pair of projecting horns of each of the cleats.

3. The organizer of claim 2, wherein the pair of USB cord clips are attached to the rotating port.

* * * * *